US005729943A

United States Patent [19]

Cambiuzzi

[11] Patent Number: 5,729,943

[45] Date of Patent: Mar. 24, 1998

[54] BUILDING BLOCK, A PROCESS FOR ITS MANUFACTURE AND A BUILDING STRUCTURE PRODUCED USING THESE BLOCKS

[75] Inventor: Giulio Cambiuzzi, Imola, Italy

[73] Assignee: Sirprogetti S.r.l., Milan, Italy

[21] Appl. No.: 513,875

[22] PCT Filed: Nov. 15, 1993

[86] PCT No.: PCT/EP93/03203

§ 371 Date: Jul. 18, 1995

§ 102(e) Date: Jul. 18, 1995

[87] PCT Pub. No.: WO94/11587

PCT Pub. Date: May 26, 1994

[30] Foreign Application Priority Data

Nov. 18, 1992 [IT] Italy ..... TO92A0934

[51] Int. Cl.[6] ..... E04B 2/54

[52] U.S. Cl. ..... 52/438; 52/439; 52/605; 52/607

[58] Field of Search ..... 52/437, 438, 439, 52/442, 596, 604, 605, 606, 607, 608, 609

[56] References Cited

U.S. PATENT DOCUMENTS

| | | | |
|---|---|---|---|
| 2,029,586 | 2/1936 | Rendoff | 52/604 X |
| 2,141,035 | 12/1938 | Daniels | 52/604 X |
| 2,498,276 | 2/1950 | Kany | 52/438 |
| 2,655,032 | 10/1953 | Zagray | 52/437 X |
| 2,749,739 | 6/1956 | Zagray | 52/437 X |
| 3,422,588 | 1/1969 | Stewart, Jr. | 52/605 X |
| 4,426,815 | 1/1984 | Brown | 52/605 X |
| 4,442,237 | 4/1984 | Zimmerman et al. . | |
| 4,642,319 | 2/1987 | McDaniel . | |

FOREIGN PATENT DOCUMENTS

| | | | |
|---|---|---|---|
| 0161039 | 11/1985 | European Pat. Off. . | |
| 457615 | 11/1991 | European Pat. Off. | 52/596 |
| 651576 | 2/1929 | France | 52/604 |
| 2544196 | 4/1977 | Germany | 52/604 |
| 3727584 | 3/1989 | Germany | 52/596 |

*Primary Examiner*—Carl D. Friedman
*Assistant Examiner*—Kevin D. Wilkens
*Attorney, Agent, or Firm*—Sughrue, Mion, Zinn, Macpeak & Seas, PLLC

[57] ABSTRACT

A building block comprises a transverse groove (12) in each end face (10*b*, 10*c*), an opening (15) extending from the first (10*e*) to the second bearing face (10*d*) in which a longitudinal groove (13, 14) is also provided. The block is further provided with reference and positioning structure comprising a pair of longitudinal seats on the first bearing face and a pair of projections, each divided into three projection portions, on the second bearing face. When a building structure is constructed, the blocks 10 are superposed dry and in a staggered arrangement in superposed rows, such that the longitudinal seats of each block engage the projections on the blocks of the underlying row. The apertures and the grooves in the blocks constituting the building structure form a grid of intersecting vertical and horizontal channels which extend over the entire building structure, and in which a binder is poured and solidifies, ensuring that the building structure is stable and resistant over time.

4 Claims, 6 Drawing Sheets

BUILDING BLOCK, A PROCESS FOR ITS MANUFACTURE AND A BUILDING STRUCTURE PRODUCED USING THESE BLOCKS

BACKGROUND OF THE INVENTION

The present invention relates to a building block of the type comprising:

first and second, opposite bearing faces;

two opposite end faces, substantially at right angles to the first and second bearing faces;

at least one aperture extending from the first bearing face to the second;

at least one transverse groove in the end faces, extending from the first bearing face to the second;

at least a first and a second longitudinal groove on the first and second bearing faces respectively; and block reference and positioning means.

A block of known type and indicated above is illustrated, for example, in the Italian Patent Application No. 68558-A/77, corresponding to the U.S. Pat. No. 4,110,949, and is illustrated in FIG. 1 appended to the present description. The use of a plurality of these blocks of known type enables a building structure to be constructed by the superposition of these blocks in the dry state and in staggered rows. These blocks are then connected and positioned by hand or with a tool on sliding couplings in vertical holes in the body of the block such that they are moved axially in respective holes, for a movement equal to approximately half the height of the block, such that they engage half-way in corresponding holes in the underlying block. The transverse grooves and apertures, disposed with vertical axes, together with the longitudinal channels in the block, help to forms grid of intercommunicating vertical and horizontal channels in the resultant building structure. Following the laying of the rows of blocks and their connection by the couplings, concrete is poured into the vertical channels and can thus easily also extend into the horizontal channels, giving rise to the formation of a concrete grid.

A disadvantage of using blocks of known type for producing these building structures is that laying the blocks dry in superposed rows is very laborious, the couplings of the upper blocks having to be centred perfectly with the corresponding holes in the lower blocks. Furthermore, owing to the manufacturing tolerances of the blocks, the resultant building structure has fissures between adjacent blocks which may be very large since the longitudinal position of each single block is determined clearly by the longitudinal and transverse positions of the blocks the underlying row.

The presence of fissures between the blocks is very harmful since they can be infiltrated by water, in particular, which freezes during cold weather and can cause cracks in the building structure or even damage it, thus compromising its integrity, its aesthetic appearance and its mechanical and insulation properties.

SUMMARY OF THE INVENTION

The object of the present invention is to produce a building block of the above-mentioned type which overcomes the above disadvantages and which is in particular simple and economical to use in the production of a building structure, accelerating the construction work and reducing the occurrence and size of fissures between adjacent blocks.

Furthermore, the scope of the present invention is to produce a building block which is simple and economical to manufacture, enabling it to be produced easily on a large scale and a high standard of quality to be attained.

A further object of the present invention is to provide a modular building block for producing building structures which are also complex and maintain good orthogonal characteristics relative to the ground, even for considerable heights, and which have good anti-seismic and solidity characteristics, good characteristics of resistance to atmospheric agents and habitability, and which also have a pleasant aesthetic appearance.

A further object of the present invention is to produce a building block of the above type, of which the use in the production of a building structure involves the production of a grid of channels into which the binder, in particular concrete, can be poured rapidly and easily, such that, when it has solidified, a grid which is as homogeneous and free of empty spaces or bubbles as possible is produced, thus providing maximum anchorage.

In order to achieve the above objects, the subject of the present invention is a building block of the type described above, characterised in that the block reference and positioning means comprise at least one longitudinal seat on the first bearing face and at least one longitudinal projection on the second bearing face comprising at least one projection portion extending longitudinally for a length which is shorter than the length of the block.

The subject of the present invention is also a building structure obtained using the above blocks, as well as a process which is particularly suitable for the construction of these blocks.

Using the building blocks according to the present invention, it is possible to produce building structures intended for the construction of buildings, in particular buildings for use as dwellings, with considerable habitability characteristics ensured by a quantity of bricks in the finished building structure which is at least five times greater than the volume of binder.

Further, building structures using these blocks can also be produced by non-specialist workers, rendering the building process rapid and economical with respect to known methods.

With the blocks according to the present invention it is further possible to erect very high building structures in the dry state before the binder is poured in, by virtue of the secure and ample bearing of each row of blocks on the underlying row of blocks, the maintenance of good flatness of the lateral surfaces of the building structure and an angle of inclination which is constant with respect to the base plane, equal to the angle of inclination imposed when the first row of blocks is put in place, being ensured.

In order to reduce the possible infiltration of water through superposed rows of blocks, the present invention further has as its subject a building block of the above type, characterized in that, on the lateral surface intended to be exposed to atmospheric agents during construction, it comprises a longitudinal groove disposed in the vicinity of the upper face of the block such that, in the final building structure, the bearing zone between an upper block and a lower block is protected from the rain, even in cases in which the rain falls at a given angle to the building structure.

An advantage resulting from the use of the above longitudinal groove is that the building structure is given a pleasant aesthetic appearance, simulating a conventional construction of the so-called "decorative stone" type. This aesthetic effect can be further accentuated, for example by colouring the base of this longitudinal groove in a different colour from the lateral face of the block.

A further characteristic of the building block according to the present invention consists in the production of the above longitudinal projections by projection portions at a longitudinal spacing of a size which is equal to or greater than the width of the portions of the lower face of the block intended to bear on the underlying row of blocks. Thus, during the drying and firing steps of their production, the blocks can be stacked in an arrangement in which the longitudinal axes of the vertically adjacent blocks are staggered at right angles. This arrangement allows high productivity in the block-manufacturing process, at the same time ensuring that all the surfaces are aerated in order to achieve uniform drying and firing, allowing homogeneous shrinkage of the blocks without giving rise to dangerous internal stresses or, worse, fissuring, cracks or breaks. Further, this arrangement means that the projections on the lower blocks are not loaded with the weight of the overlying blocks, thus maintaining the planned integrity and dimensional and geometric tolerances.

A further characteristic of the present invention consists in the production of enlarged portions on the longitudinal seats, so as to facilitate the positioning of a block on the underlying row of blocks by the insertion of the projection portions in the enlarged portions and the successive longitudinal sliding of the block to centre these projection portions on the flanks of the longitudinal seats. Furthermore, the production of these enlarged portions enables the extension of the line of longitudinal seats which has to be ground during production of the blocks to be restricted, with the consequent saving in time and material and with reduced wear of the grinding wheel.

BRIEF DESCRIPTION OF THE DRAWINGS

Further characteristics and advantages of the invention will become clear from the following description with reference to the appended drawings, provided purely byway of non-limiting example, in which.

DETAILED DESCRIPTION OF THE INVENTION

Figure 1:
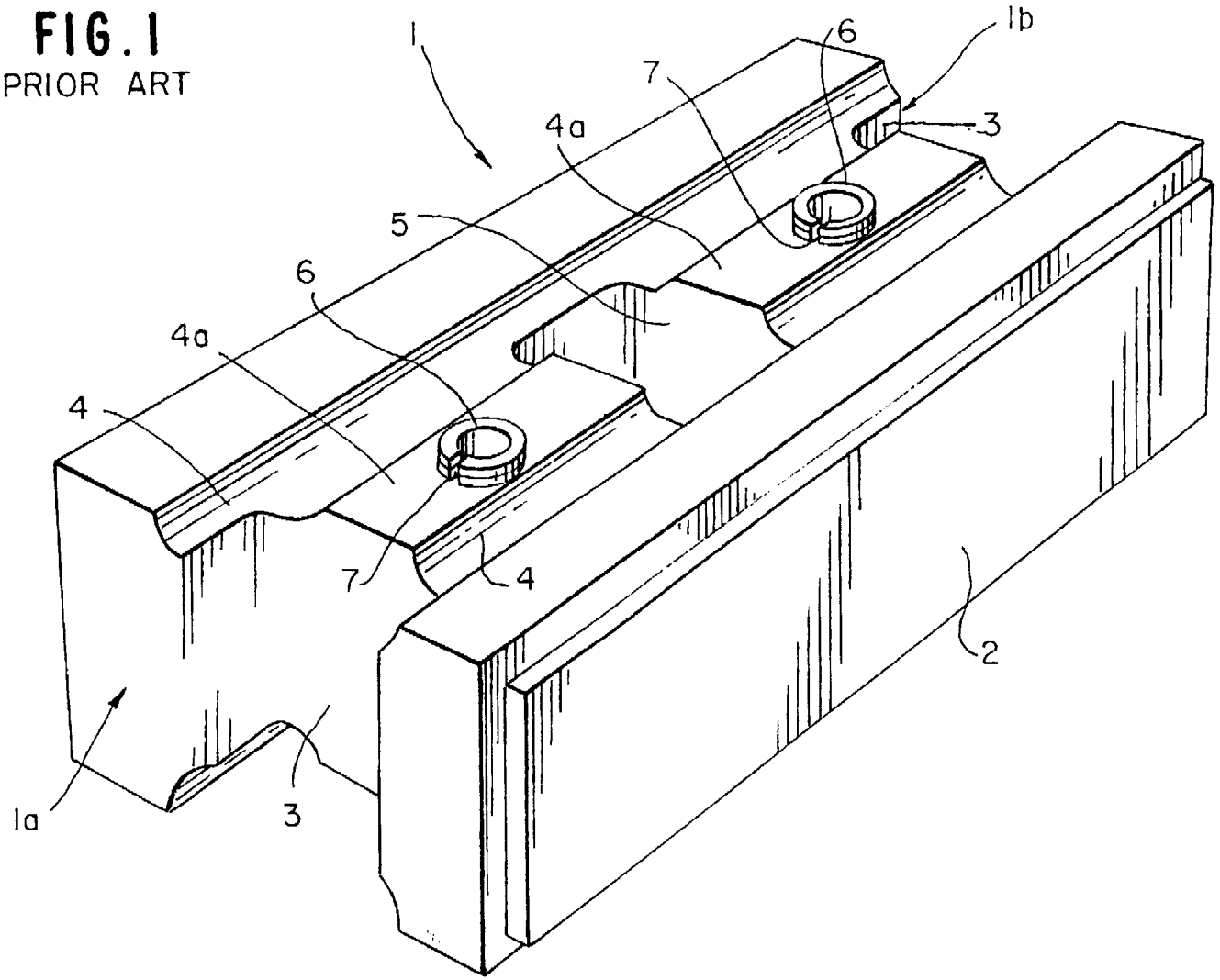
FIG. 1 PRIOR ART
FIG. 1 is a perspective view of a building block of known type.

With reference to FIG. 1, the block 1 illustrated is a parallelepipedal block, for example, made of brick and provided with a part 2 in relief on one face intended to be turned towards the exterior in a building structure produced by these blocks.

Each of the end faces 1*a*, 1*b* has a wide, vertical groove 3. The upper and lower faces of the block 1 each have a central depression, extending longitudinally and comprising two parts with channels 4 having substantially semicircular profiles separated by a flat part 4*a*. An aperture 5 with a quadrangular profile and sides parallel with the lateral faces of the block 1 opens out in the bases of these two longitudinal channels 4. The aperture 5 extends vertically over the entire height of the block, and a median plane of the block, parallel with the end faces, constitutes a plane of symmetry through this aperture, dividing it into two equal parts disposed symmetrically relative to this plane.

In cross-section, the vertical grooves 3 have profiles identical to that of each of the above two parts of the central aperture 5.

Two vertical, cylindrical holes which are disposed symmetrically relative to the aperture 5 and in each of which a coupling 6, for example of plastics material, is housed, the coupling being provided with a longitudinal notch 7, open out on the flat parts 4*a*, from opposite sides of the opening 5. The length of the coupling 6 is equal to the height of the block 1 through which the two ends of the coupling project from the flat parts 4*a*, as illustrated in FIG. 1.

When a wall is constructed, the blocks are superposed in the dry state in staggered rows and are connected and positioned manually or with a tool on the couplings 6 of the upper block such that they are moved axially in the respective holes for a movement equal to approximately half the height of the block. As a result of this movement, the couplings 6 engage half-way in the underlying block.

Figure 2:
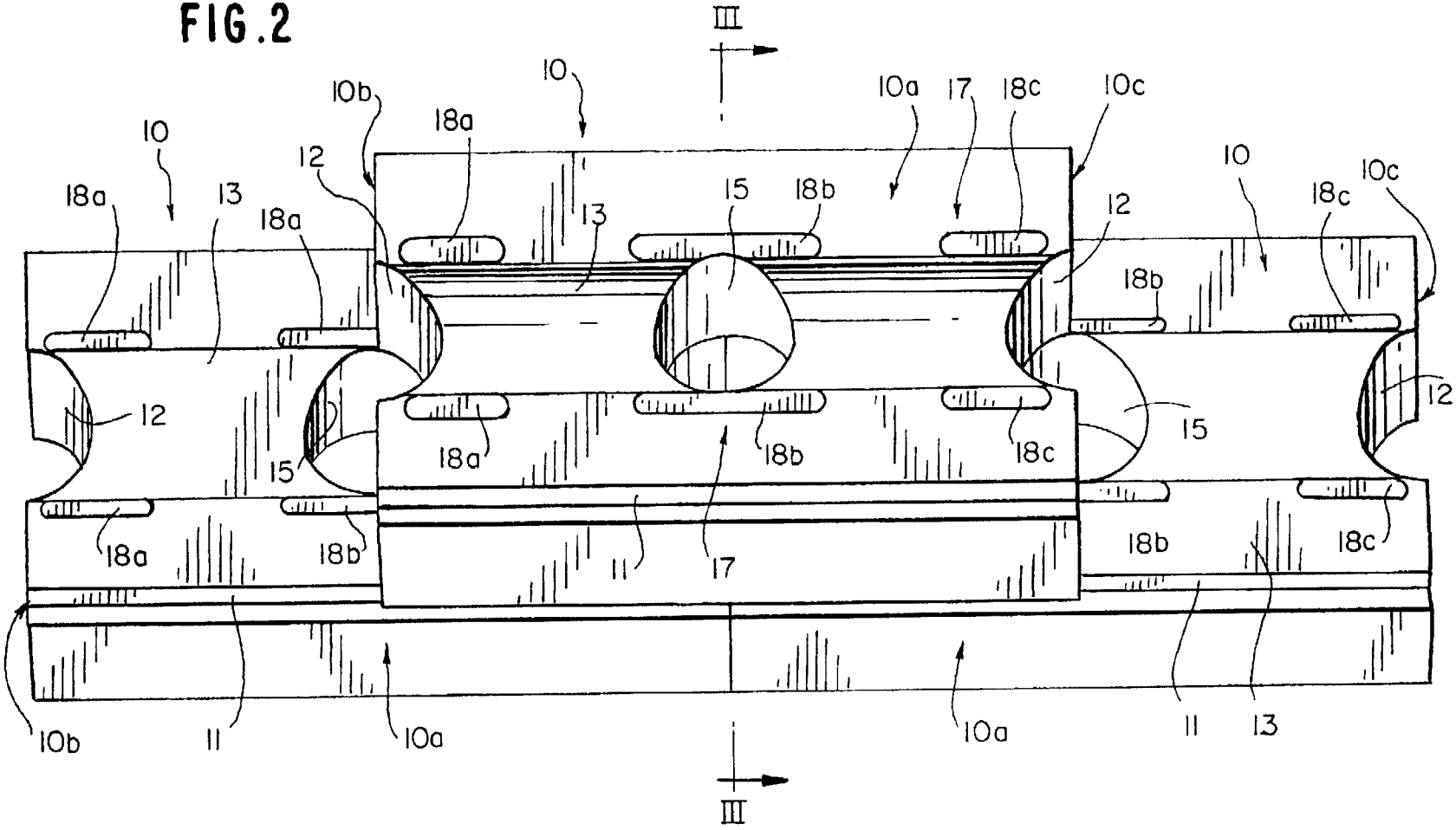
FIG. 2 is a perspective view of three building blocks according to the present invention, in an arrangement in which they are assembled in the dry state for the production of a portion of a building structure.
Figure 3:
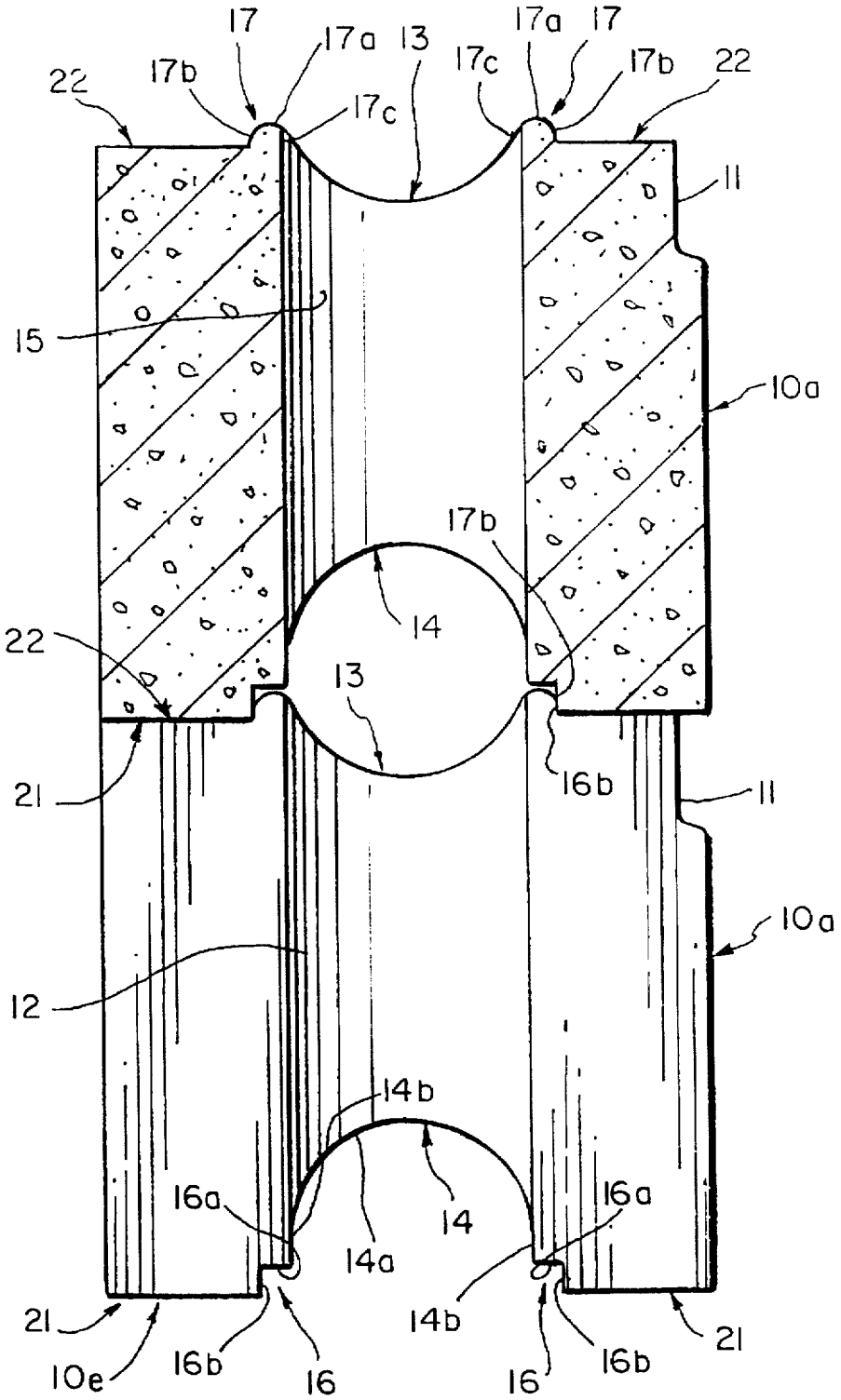
FIG. 3 is a section along the line III—III of FIG. 2.
Figure 4:
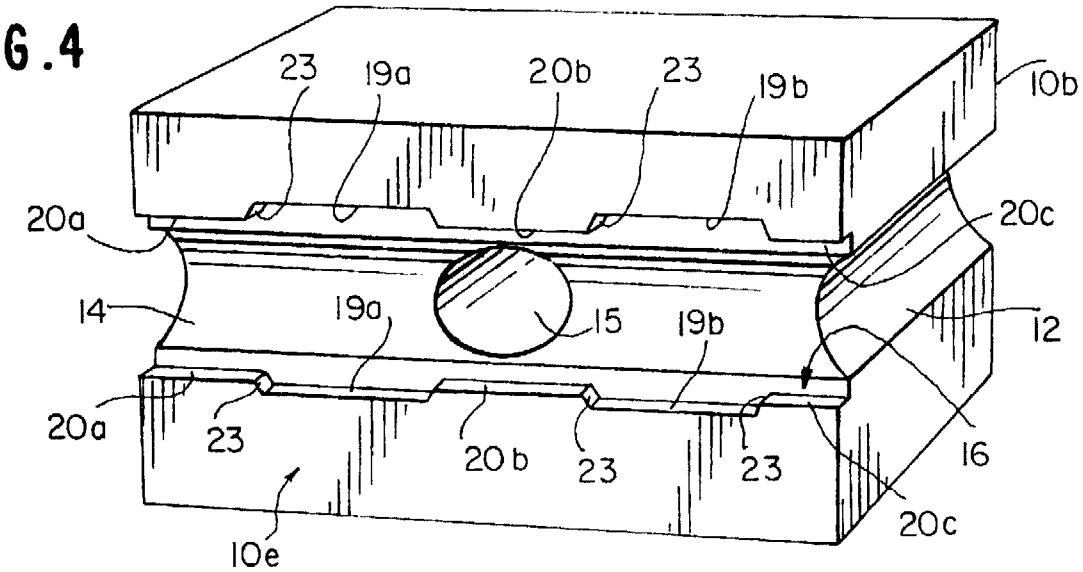
FIG. 4 is a perspective view of the lower part of a block according to the present invention.

FIGS. 2 to 4 illustrate three blocks 10 of the present invention disposed in a staggered arrangement, jointly adapted for the construction of a building structure. Each block 10, made of brick or similar material, is provided with a longitudinal groove 11 on the upper portion of the face 10*a*, intended to be turned towards the exterior in a building structure produced using these blocks.

Each of the end faces 10*b*, 10*c* has a wide vertical groove 12, preferably having a semicircular profile. The upper bearing face 10*d* and the lower bearing face 10*e* of the block 10 each have an upper central groove 13 and lower central groove 14 respectively (cf. FIGS. 3 and 4), having a substantially curved, concave profile which is constant over the entire length of the block. In particular, the upper groove 13 has an arcuate profile with an opening angle of less than 180° and preferably of approximately 90°. The lower groove 14 preferably has a central portion 14*a* with a semicircular profile extending with two rectilinear flanks 14*b* which are substantially parallel or slightly divergent to facilitate the operations for forming the block 10.

An aperture 15 with a circular profile and a radius substantially equal to the radius of the groove 12, which extends vertically over the entire height of the block 10, opens out at the base of these two central grooves 13 and 14. A median plane of the block, parallel with the end faces 10*b*, 10*c*, constitutes a plane of symmetry through the aperture 15, ideally dividing it into two equal, semicircular parts, disposed symmetrically relative to this plane. On the lower face 10*e* of the block 10 (cf. FIGS. 3 and 4), on the sides of the longitudinal grooves 14, there are two longitudinally extending symmetrical seats 16 which each have a horizontal face 16*a*, substantially parallel with the lower face 10*e* of the block 10, and a vertical face 16*b*, substantially perpendicular to the face 16*a* and turned towards the interior of the groove 14.

Two longitudinal projections 17, disposed symmetrically relative to a longitudinal median plane, extend on the upper face 10*d* of the block 10. At the top, the projections 17 project relative to the upper face 10*d* of the block 10 and each have a cross-section with an external side 17*b* substantially perpendicular to the upper face 10*d* of the block and an upper side 17*a* advancing in a convex, curved manner and connected, by a connection part 17*c*, to the concave profile of the upper longitudinal channel 13. By virtue of this connection 17*c*, the base of the projections 17 is strengthened, since the concentration factor of the stresses is reduced, thus imparting good overall mechanical resistance to the projections 17.

As illustrated in FIG. 2, each projection 17 preferably consists of three longitudinal projection portions 18*a*, 18*b* and 18*c*, which follow one another in the longitudinal direction and are spaced apart from one another by a distance which is greater than or equal to the width of one of the two flat surfaces 21 in which the groove 14 divides the lower face 10*e* of the block. In particular, the two end projection portions 18*a* and 18*c* have an end adjacent the end faces 10*b*, 10*c* respectively of the block, whilst the central projection portion 18*b* is disposed symmetrically relative to the median plane of symmetry of the block.

The longitudinal seats 16 (cf. FIG. 4) each have, along their longitudinal extensions, two enlarged portions 19*a*, 19*b*, disposed symmetrically relative to the above median plane of the block and each having a longitudinal extension at least equal to the length of the larger of the projection portions 17*a*, 17*b*, 17*c*. By virtue of the presence of the enlarged portions 19*a*, 19*b*, the configuration of the longitudinal seats 16 thus assumes an appearance which is complementary to that of the projections 17, having three seat portions 20*a*, 20*b*, 20*c*, following one another in the longitudinal direction and at a spacing, as well as being symmetrical relative to the above median plane of the block. The seat portions 20*a*, 20*b*, 20*c* can conveniently be connected to the enlarged portions 19*a*, 19*b* by means of connection parts 23.

When a building structure is constructed, the blocks 10 are superposed dry in staggered rows as illustrated in FIG. 2. The blocks 10 in a given row are disposed adjacent one another, and the blocks in an overlying row are positioned relative to the lower blocks by the engagement of the longitudinal seats 16 in the projections 17. In the assembled state, illustrated in FIGS. 2 and 3, the flat surfaces 21 of the lower face 10*e* of a block bear on flat surfaces 22 of the underlying blocks and the flanks 16*b* of the longitudinal seats 16 come into contact with the flanks 17*b* of the projections 17 of the underlying blocks. The height of the projections 17 relative to the bearing surfaces 22 is less than the depth of the seats 16 relative to the surfaces 21, such that the bearing of a block on the underlying row of blocks is clearly determined simply by the surfaces 21 bearing on the surfaces 22, resulting in a solid and stable construction.

The erection of the building structure in the dry state is also very rapid owing to the ease with which the blocks can be positioned on the underlying rows of blocks. In fact, each block bears on the underlying row such that the two pairs of enlarged portions 19*a*, 19*b* are positioned in correspondence with two respective pairs of consecutive projection portions. In this situation, the flanks 17*b* of the projections do not interfere with the lateral parts of the enlarged portions 19*a*, 19*b*.

Subsequently, the blocks of each row are made to slide longitudinally along the underlying row of blocks such that the projection portions 18*a*, 18*b*, 18*c* fit into the seat portions 20*a*, 20*b*, 20*c*, engaging their flanks. The positioning of the projection portions in the enlarged portions and the subsequent fitting in the seat portions is facilitated by the curved profiles 17*a* of the projection portions and by the connection parts 23 between the seat portions and the enlarged portions 19*a*, 19*b*.

The fact that the blocks 10 can slide longitudinally also allows the adjacent blocks in a given row to be positioned side-by-side correctly, thus taking up any clearance owing to manufacturing tolerances.

In the resultant building structure, the vertical apertures 15 in each block are substantially aligned with the vertical apertures formed by the two facing grooves 17 of the two underlying (or overlying) blocks, which gives rise to the formation of continuous vertical channels with circular profiles for the subsequent pouring in of the binder; furthermore, the longitudinal grooves 13 and 14 in the faces of the blocks of adjacent rows form horizontal channels communicating with the above vertical channels and having an overall profile similar to a circular profile, as shown in FIG. 3.

Figure 5:
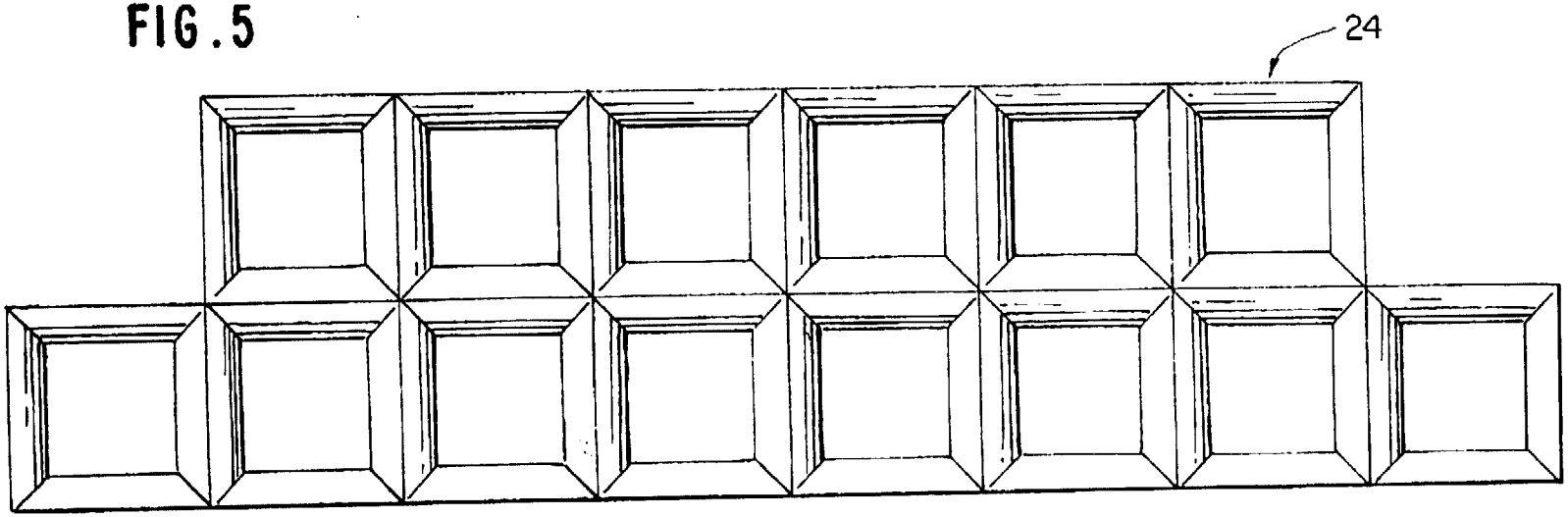
FIG. 5 is an elevation view of a portion of the grid alone when the binder has solidified, on completion of production of the building structure.

The binder, such as concrete or the like, is then poured into the vertical channels, and can then also easily extend with reduced flow resistance into the horizontal channels, giving rise to the formation, following solidification, of a uniform and compact grid, such as the one generally indicated 24 in FIG. 5, which thus ensures a good connection between the blocks 10 and good mechanical characteristics of the building structure. The substantially circular configuration of the profiles of the vertical and horizontal channels allows the binder to be distributed as uniformly as possible, with the consequent reduction of the risks of the formation of air sacs, empty spaces or bubbles in the solidified grid.

Figure 6:
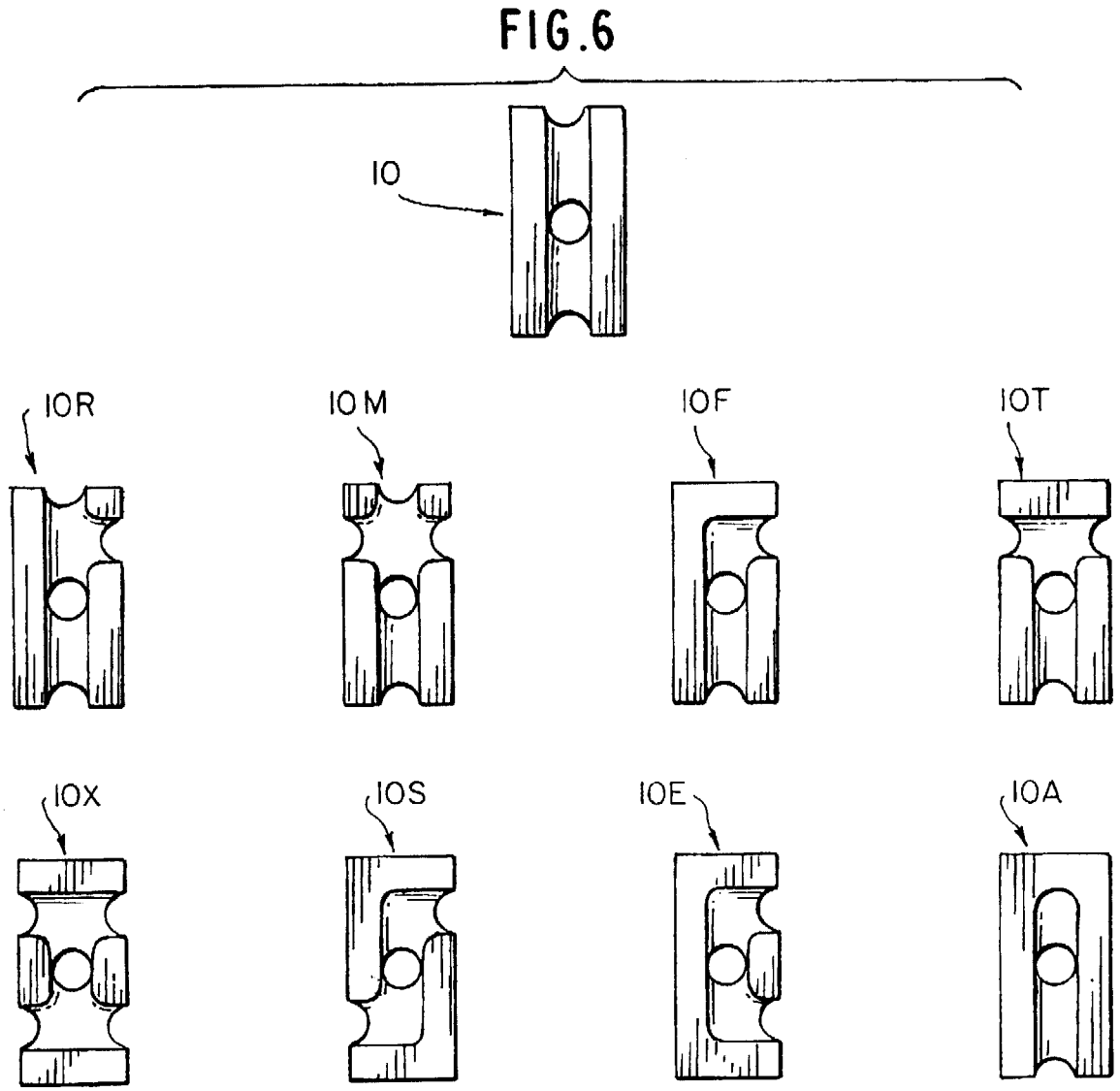
FIG. 6 is a plan view of a group of blocks according to the present invention, showing some variants of configurations for producing complex building structures.

FIG. 6 illustrates diagrammatically a series of building blocks according to the present invention showing variants of the arrangement of the grooves on the bearing faces and of the vertical grooves, for the production of complex building structures. In particular:

the basic block described above is indicated 10;

a block for the production of a building structure having in plan view a side branch at a right angle is indicated 10R;

a block for the production of a building structure intersecting another building structure at right angles is indicated 10M;

a block for the production of a building structure forming a right angle is indicated 10F;

a block for the production of a T-shaped building structure is indicated 10T;

a block for the production of a transverse connection between two parallel, adjacent building structures is indicated 10X;

a block for the production of a projection or recess in a building structure is indicated 10S;

a block for the production of a terminal header for two parallel, adjacent building structures is indicated 10E; and a block for the production of a header for a single building structure, for example for producing openings for doors or windows is indicated 10A.

The wall facing the exterior of the building structure produced according to the above-described process has a pattern of continuous horizontal grooves formed by the grooves 11 in the blocks 10 being brought together. Apart from performing a pleasing aesthetic function, this pattern prevents the infiltration of rainwater between the surfaces 18 and 19 of the superposed blocks. In fact, the lower portion of the lateral face 10*a* of each block, intended to be turned towards the exterior, forms a type of roof for protection against the rain even when it is falling at a given angle of inclination relative to the outer wall of the building structure. It will be appreciated that the blocks 10, intended for the production of building structures not exposed to atmospheric agents, for example for internal partition walls of dwelling rooms, do not require the grooves 11 and can be produced with both lateral walls continuous.

In each case, independently of the function of protection against atmospheric agents, the lateral faces of the blocks 18 may have any pattern in relief or be decorated or covered in any known manner for the production of both internal and external finished building structures. In the case of the blocks comprising the horizontal grooves 11, the latter can be coloured differently with respect to the remaining portions of the lateral face 10*e* of each block, such that decorative patterns are also produced on the external walls of the construction.

The process for constructing the above-described building blocks is substantially the same as the known process for producing conventional bricks and comprises a first step for forming a material, for example based on clay mixed with water, followed by the drying and firing steps to eliminate the water from the mixture, according to the technique known in the brickmaking industry.

Figure 8:
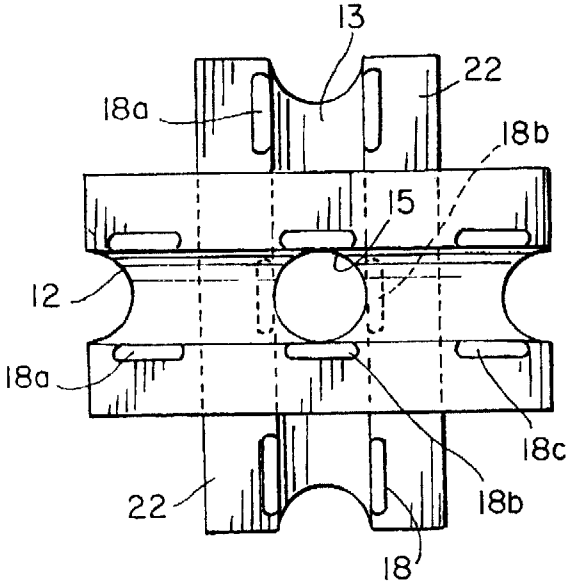
FIG. 8 is a plan view according to the arrow VIII of FIG. 7.
Figure 7:
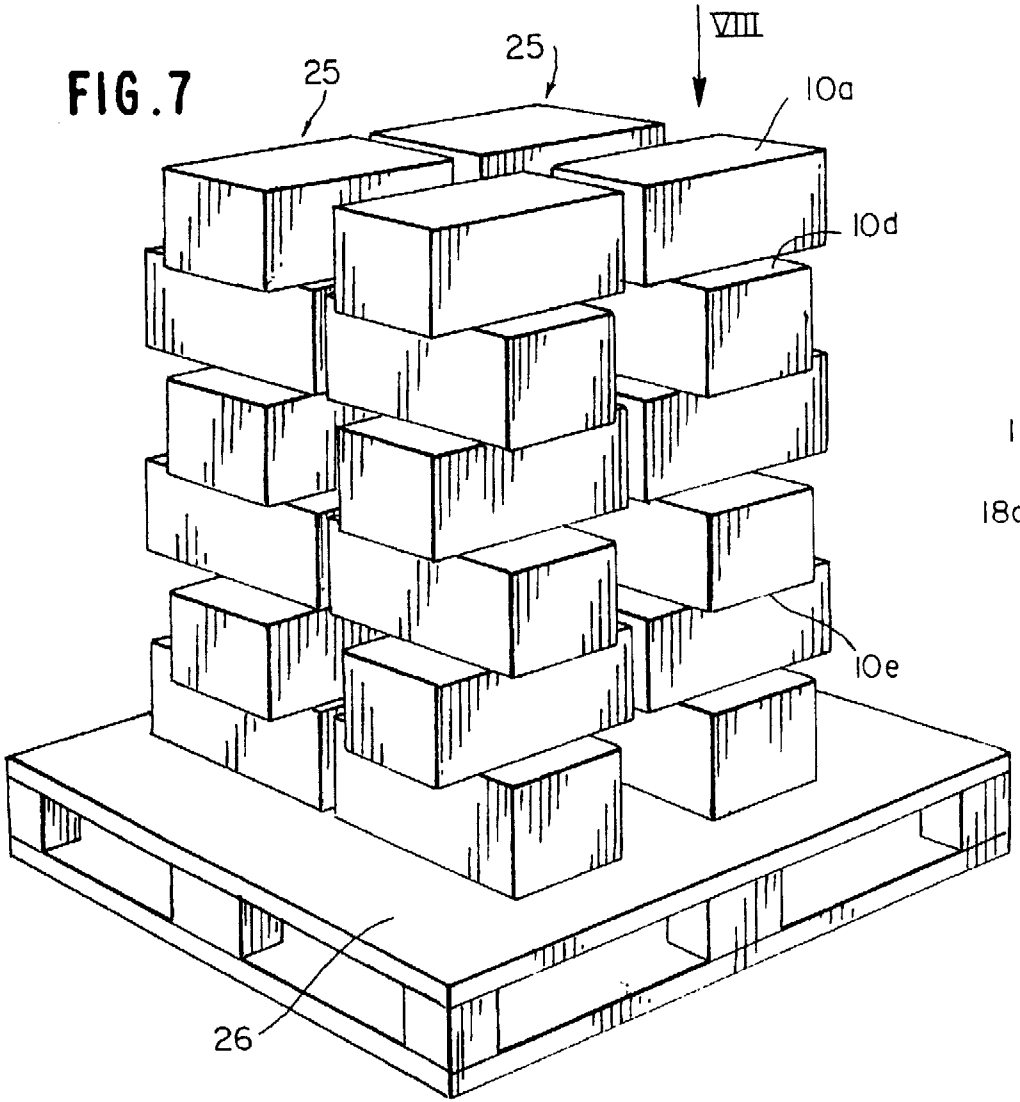
FIG. 7 is a diagrammatic perspective view of a group of stacked blocks, in the preferred configuration adopted during the drying and firing steps of the blocks themselves.

During the drying and firing steps, the blocks formed can conveniently be stacked in parallel stacks 25 in which each block in a given stack is disposed with its longitudinal axis oriented substantially at right angles relative to the longitudinal axes of the adjacent upper and lower blocks, as illustrated in FIGS. 7 and 8. In this arrangement, a portion of the flat, lower face 10*e* of each block bears on a portion of the flat, upper face 10*d* of the underlying block, this arrangement being possible by virtue of the spaces between the projection portions 18*a*, 18*b* and 18*c*. The lower blocks in each stack 25 bear on a refractory support 26 with their flat, lower surfaces 21. By virtue of this arrangement, each block 10 is free to shrink as it dries in chambers and is fired in the kiln, without either the structural and geometric integrity, that is, the profiles of the projections 17 which, owing to their limited thickness, are very fragile before firing, or the overall integrity of each block 10 being impaired.

The refractory support 26 can be an integral part of or mounted on a truck for transporting the blocks 10 to the drying and firing stations, so as to simplify the production cycle.

Following drying and firing, each block 10 is ground at the flat, lower and upper surfaces 21 and 22, at the flanks 16*b* of the seats 16, at the flanks 17*b* of the projections 17 and at the end faces 10*b* and 10*c*. In particular, a considerable amount of time and material is saved by virtue of the presence of the enlarged portions 19*a*, 19*b*, of which the flanks do not require grinding. A building block is thus produced with very narrow dimensional and geometric tolerances and can easily be used to produce building structures which are solid, stable and straight even before the binder is poured in.

The vertical and horizontal channels produced during the formation of a building structure using the blocks described above lend themselves to the accommodation of tubes intended to contain electrical leads or for producing the hydraulic installations for the construction. Further, reinforcing rods can be inserted in the vertical and horizontal channels to produce constructions with optimum anti-seismic properties. It is also possible to produce special blocks already having apertures for the arrangement, for example, of light sockets, switches, connections for the outlets of hydraulic pipes and the like.

The advantages of the block described above will be evident from the above description and can be summarized as follows:

- the attainment of a concrete grid with vertical and horizontal parts, both having substantially equal sections;
- the horizontal and vertical parts of the grid 24 can also be obtained using semi-fluid mixtures of concrete or other binders, given the reduced flow resistance of the horizontal channels, to bring about efficient sealing with respect to atmospheric agents, since the horizontal and vertical channels have substantially circular, uniform, curved sections which reduce the risks of air sacs forming;
- the block can easily be obtained by forming, and lends itself easily to the grinding of the coupling faces and surfaces;
- the profile of the horizontal channels facilitates the insertion of the leads of the electrical installation and enables anti-seismic structures to be produced easily with the use of reinforcing rods;
- the blocks can easily be stacked in single stacks for a proper drying and firing process, with the greater part of their surfaces exposed to the air, of which the circulation is also favoured by the presence of the apertures and transverse and longitudinal grooves, such that they are thus free to shrink owing to the elimination of the water from the mixture, with the consequent reduction of the risks of internal stresses, cracks, lesions or breaks forming;
- the blocks permit considerable speed and ease of assembly for the production of building structures, with the possibility of the clearance between adjacent blocks derived from possible manufacturing tolerances being eliminated;
- the building structures produced with these blocks have good characteristics of solidity and flatness of the external surfaces since the bearing between superposed rows of blocks is concentrated on the upper and lower ground, flat faces 21 and 22;
- after drying, the projections 17 have good resistance owing to the connection between their upper curved surface 17*a* and the upper longitudinal groove 13;
- the maintenance of high productivity of the block manufacturing process;
- good sealing with respect to the infiltration of water;
- a low binder—block ratio (the volume of material constituting the blocks is at least five times greater than the volume of binder constituting the grid-like reinforcing framework) which improves the fitness of the buildings constructed using these blocks for habitation, and accelerates the construction process since a smaller quantity of binder has to be prepared when the building structure is produced.

I claim:

1. A building structure comprising a plurality of blocks (10) which are substantially similar and disposed in horizontal rows, each block comprising:

- first and second opposite bearing faces;
- two opposite end faces disposed substantially at right angles to said first and second bearing faces;
- at least one aperture extending from said first bearing face to said second bearing face;

at least one transverse groove in each end face extending from said first bearing face to said second bearing face;

a longitudinal groove on each of said first and second bearing faces, each groove having a profile such that a longitudinal median plane which is perpendicular to the respective bearing face constitutes a plane of symmetry for each groove, each groove further defining on the respective bearing face a pair of flat surfaces disposed symmetrical relative to said longitudinal median plane;

block reference and positioning means comprising a pair of longitudinally extending seats on said first bearing face and a pair of longitudinally extending projections on said second bearing face, each pair being disposed symmetrically relative to said longitudinal median plane in the vicinity of the longitudinal grooves;

wherein said projections project relative to said second bearing face by an amount which is less than the depth of said seats relative to said first bearing face; and wherein each projection is comprised of a median portion and two end projection portions, said portions being longitudinally spaced from one another by a distance which is equal to or greater than the width of each of said flat surfaces defined on either side of the longitudinal groove on the first bearing face, and wherein each longitudinal seat comprises at least one enlarged portion extending longitudinally over a length which is at least equal to the length of at least one projection portion, whereby the projections on one block may be completely received within the seats of an adjacent block to bring said bearing faces into contact with each other, the blocks of each row being staggered relative to the blocks in the adjacent row, each block being supported by at least part of its first bearing face (10*e*) on at least part of the second bearing face (10*d*) of a block of the underlying row, the transverse grooves (12) in the end faces of each block being disposed vertically and positioned such that they correspond with at least one transverse groove (12) in an adjacent block, forming at least one vertical channel between the blocks so as to be aligned with at least one aperture (15) in the blocks of the adjacent rows, the longitudinal grooves (13) on the upper faces of the blocks forming, with the longitudinal grooves (14) on the faces of the blocks of the overlying row, longitudinal grooves intersecting the vertical channels, a body of poured binder filling the vertical and longitudinal channels forming a grid-like reinforcing framework (24) over the entire height and the width of the building structure, characterized in that the longitudinal seats (16) on the lower faces (10*e*) of the blocks engage, at least partially, flanks (16*b*), in the projections (17) on the upper faces (10*d*) of the blocks in the underlying row so as to produce longitudinal reference and positioning transverse guides for the blocks (10) in adjacent rows.

2. A building structure according to claim 1, wherein each block has a longitudinal groove (11) on a lateral face (10*a*), intended to form the outer wall of the building structure, said longitudinal groove being covered at the top by part of the lower faces (10*e*) of the blocks of the overlying row which form a protective roof for the space between rows of adjacent blocks.

3. A building structure according to claim 2, characterized in that the longitudinal grooves (11) have a different colour from the lateral faces (10*a*) of the blocks.

4. A building structure according to claim 1, characterized in that the volume of material constituting the blocks (10) is at least five times greater than the volume of binder constituting the grid-like reinforcing framework (24).

* * * * *